US011174446B2

(12) United States Patent
Li et al.

(10) Patent No.: US 11,174,446 B2
(45) Date of Patent: Nov. 16, 2021

(54) WINTERIZED POUR POINT DEPRESSANTS

(71) Applicant: NOURYON CHEMICALS INTERNATIONAL B.V., Arnhem (NL)

(72) Inventors: Lingling Li, New Fairfield, CT (US); James Frederic Gadberry, Danbury, CT (US); Tiara Elizabeth O'Neal, Danbury, CT (US); Chandrashekhar Yeshwant Khandekar, Katy, TX (US)

(73) Assignee: NOURYON CHEMICALS INTERNATIONAL B.V., Arnhem (NL)

( * ) Notice: Subject to any disclaimer, the term of this patent is extended or adjusted under 35 U.S.C. 154(b) by 34 days.

(21) Appl. No.: 16/609,160

(22) PCT Filed: Jun. 25, 2018

(86) PCT No.: PCT/EP2018/066870
§ 371 (c)(1),
(2) Date: Oct. 28, 2019

(87) PCT Pub. No.: WO2019/002167
PCT Pub. Date: Jan. 3, 2019

(65) Prior Publication Data

US 2020/0224113 A1 Jul. 16, 2020

Related U.S. Application Data

(60) Provisional application No. 62/525,273, filed on Jun. 27, 2017.

(30) Foreign Application Priority Data

Sep. 6, 2017 (EP) ..... 17189607

(51) Int. Cl.

| | |
|---|---|
| ***C10L 10/16*** | (2006.01) |
| ***C10L 1/196*** | (2006.01) |
| ***C10L 1/16*** | (2006.01) |
| ***C10L 1/198*** | (2006.01) |
| ***C10L 1/24*** | (2006.01) |
| ***C10L 1/222*** | (2006.01) |
| ***C10L 1/223*** | (2006.01) |
| ***C10L 1/182*** | (2006.01) |
| ***C10L 1/185*** | (2006.01) |

(52) U.S. Cl.
CPC ..... *C10L 10/16* (2013.01); *C10L 1/1616* (2013.01); *C10L 1/1824* (2013.01); *C10L 1/1826* (2013.01); *C10L 1/1852* (2013.01); *C10L 1/1966* (2013.01); *C10L 1/1985* (2013.01); *C10L 1/2225* (2013.01); *C10L 1/2235* (2013.01); *C10L 1/2437* (2013.01); *C10L 2230/14* (2013.01)

(58) Field of Classification Search
CPC ..... C10L 10/16; C10L 1/143; C10L 1/1608; C10L 1/1616; C10L 1/1824; C10L 1/1826; C10L 1/1852; C10L 1/19; C10L 1/1966; C10L 1/1973; C10L 1/1985; C10L 1/20; C10L 1/2222; C10L 1/2225; C10L 1/2235; C10L 1/2364; C10L 1/2437; C10L 2230/14
See application file for complete search history.

(56) References Cited

U.S. PATENT DOCUMENTS 3,775,051 A * 11/1973 Graff ..... D06M 13/463 8/115.6
2018/0355266 A1 12/2018 Castro et al.

FOREIGN PATENT DOCUMENTS

GB 2308129 A * 6/1997 ..... C10L 1/2475
GB 2308129 A 6/1997
WO 2016069524 A1 5/2016
WO 2017089212 A1 6/2017

OTHER PUBLICATIONS

ISA—EPO, International Search Report and Written Opinion issued in International Application No. PCT/EP2018/066870, dated Aug. 21, 2018.

* cited by examiner

*Primary Examiner* — Ellen M McAvoy
*Assistant Examiner* — Chantel L Graham
(74) *Attorney, Agent, or Firm* — Lorenz & Kopf, LLP

(57) ABSTRACT

This disclosure relates to winterized pour point depressant compositions for petroleum fluids. Such compositions exhibit stability and are flowable at temperatures down to as low as −47° C., without the need for further dilution.

15 Claims, No Drawings

WINTERIZED POUR POINT DEPRESSANTS

CROSS-REFERENCE TO RELATED APPLICATIONS

This application is a U.S. National-Stage entry under 35 U.S.C. § 371 based on International Application No. PCT/EP2018/066870 filed Jun. 25, 2018, which was published under PCT Article 21(2) and which claims priority to European Application No. 17189607.9 filed Sep. 6, 2017 and United States Provisional Application No. 62/525,273 filed Jun. 27, 2017, which are all hereby incorporated by reference in their entirety.

TECHNICAL FIELD

This patent application relates to compositions utilized as pour point depressants for petroleum fluids.

BACKGROUND

Petroleum fluids may include, without limitation, crude oils, fuel oils, diesel fuel, hydraulic oil, oils of lubricating viscosity, and heating oils. Virtually all such oils contain small amounts of waxy materials, e.g., paraffins, alkanes, etc. that at low temperature tend to precipitate as large crystals or spherulites of wax in such a way as to form a gel structure which causes the oil to lose its ability to flow. The paraffins in such oils precipitate during the production process due to cooling and depressurization. Paraffins have a formula $C_nH_{2n+2}$ and many oil feedstock contain paraffins from $C_1$ to $C_{100+}$, and usually $C_{18+}$ paraffins present problems due to precipitation and deposition as a result of cooling process. Paraffin precipitation occurs when the process temperature falls below a critical temperature known as wax appearance temperature (WAT) and increasing quantity of wax precipitates as the temperature of the process is reduced. As the temperature is decreased, some of the waxy components come out of solution as tiny crystals, and the solution begins to appear hazy to the naked eye. The temperature at which this occurs is called the cloud point. As additional wax precipitates, the crystals grow into plates and, finally, if the temperature is decreased far enough, the plates will grow together to form a three-dimensional network that totally immobilizes the oil. This solidification process is sometimes referred to as gelation. The lowest temperature at which the oil is fluid is called the pour point.

As the temperature of the oil falls and approaches the pour point, difficulties arise in transporting the oil through lines and pumps, and the precipitated wax particles subsequently deposit in the system. Wax deposition is responsible for the reduction in oil production, in terms of maintenance and removal of deposits already formed, increasing the cost of producing and transporting oil products, and causing a number of handling problems in regions where the service temperatures are, or become seasonally very low. The ability of an oil to flow under low-temperature, low-shear conditions is crucial to the operation of equipment expected to run in cold climates. Without the proper selection and treat rate of a pour point depressant, an oil will exhibit poor low-temperature properties, leading, in the worst case, to lubrication "starvation" and equipment failure. Paraffin deposition is a function of many parameters including but not limited to fluid composition, water cut, fluid velocity, temperature etc. Wax deposits, once formed can present significant challenges in a production process such plugging of flow lines and other equipment such as heat exchangers, accumulation in storage tanks to form paraffin sludge, reduced production, stabilized emulsion, accumulation of solids in the pipelines etc.

Several thermal, mechanical and chemical treatments are used to delay paraffin precipitation and subsequent deposition. Thermal techniques include pipeline insulation to preserve the heat, which delays the paraffin precipitation and subsequent deposition. While this is an effective technique, it is extremely uneconomical especially in long transportation pipelines and hence not commonly used. Hot oiling and hot watering are commonly used on land wells to melt the paraffin deposits and are relatively inexpensive techniques. However, there are several drawbacks such as paraffin redeposition and long term formation damage Pigging is very commonly used mechanical treatment to remove paraffin deposits in the flow lines. This technique is very effective and used widely throughout, as a remediation technique to mitigate deposition issues. However, this technique cannot prevent the precipitation and deposition of paraffins in a system.

These problems are well recognized in the art, and various additives have been proposed, many of which are in commercial use, for depressing the pour point of oils. Similarly, other additives have been proposed and are in commercial use for reducing the size and changing the shape of the wax crystals that do form.

To overcome these challenges, particularly to stop the growth of wax crystal in hydrocarbon fluids, small amounts of paraffin inhibitors are continuously added in the oil feedstock. The paraffin/wax inhibitors transform the paraffin crystal formation mechanism and thus decrease the crystal growth of paraffin molecule. These paraffin inhibitors are polymers that possess long segments of repeating saturated or saturated and unsaturated carbon chain groups that are contained in or attached to a polymer backbone While the wax inhibitors, when added above the WAT prevent the paraffin deposition by modification of paraffin crystal size and shape, it is extremely difficult to winterize these polymers due to the low solubility exhibited in solvents that are used to formulate the inhibitors. The polymers are therefore diluted in solvents to achieve a low temperature stability, and as a result require high dosages to achieve the required performance.

We have found that pour point depressants with one or more hydrocarbon solvents, one or more inhibitor components, and one or more anionic and/or cationic and/or nonionic surfactants, serve effectively as pour point depressants for petroleum fluids. In addition, other objects, desirable features and characteristics will become apparent from the subsequent summary and detailed description, and the appended claims, taken in conjunction with the background.

SUMMARY

In one aspect of the present disclosure, a pour point depressant composition for a petroleum fluid is disclosed. The composition comprises: (i) acopolymer of an alpha olefin monomer and an unsaturated dicarboxylic acid anhydride monomer, converted to an ester or imide and present in an amount of about 1 to about 30 weight percent of the total weight of the composition; (ii) one or more surfactants; and (iii) at least two hydrocarbon solvents. These surfactants comprise: (i) a nonionic surfactant comprising a 2-propyl heptanol alkoxylate, wherein the alkoxylate has the formula $C_5H_{11}CH(C_3H_7)CH_2O(A)_nH$, wherein A is an alkyleneoxy group having 2 to 4 carbon atoms and n is 2 to 16, present in an amount of about 1 to about 40 weight percent of the total weight of the composition; and/or (ii) an anionic surfactant comprising an amine salt of an alkyl benzene sulfonic acid, present in an amount of about 1 or 5 to about 50 weight percent of the total weight of the composition; and/or (iii) a cationic surfactant comprising an alkoxylated amine, present in an amount of about 1 to about 40 weight percent of the total weight of the composition. The at least two hydrocarbon solvents are present in an amount of about 45 to about 99 weight percent of the total weight of the composition.

In another aspect of the present disclosure, an alternate pour point depressant composition for a petroleum fluid is disclosed. The composition comprises: (i) a copolymer of a C20-C24 alpha olefin monomer and a maleic anhydride monomer, wherein the copolymer of the C20-C24 alpha olefin monomer and the maleic anhydride monomer is (i) esterified with up to about 2 moles of an alcohol and/or glycol having from between 10 and 40 carbon atoms, which esterification is optionally catalysed with an acid catalyst or (ii) is converted to an imide by reaction with an alkyl amine, wherein the ester or imide copolymer is present in an amount of about 3 to about 15 or 25 weight percent of the total weight of the composition; (ii) one or more surfactants; and (iii) at least two hydrocarbon solvents. These surfactants comprise (i) a nonionic surfactant comprising a 2-propyl heptanol ethoxylate, wherein the ethoxylate has the formula $C_5H_{11}CH(C_3H_7)CH_2O(A)_nH$, wherein A is an ethyleneoxy group having 2 to 4 carbon atoms and n is 2 to 16, present in an amount of about 1 or 2 to about 35 weight percent of the total weight of the composition; and/or (ii) anionic surfactant comprising an isopropylamine dodecylbenzene sulfonate, present in an amount of about 1 or 10 to about 45 weight percent of the total weight of the composition; and/or (iii) cationic surfactant comprising an alkoxylated amine comprising the formula:

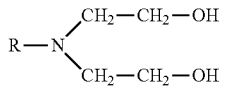

wherein R is coconut oil derived alkyls, present in an amount of about 1 or 5 to about 35 weight percent of the total weight of the composition. The hydrocarbon solvents are an aliphatic hydrocarbon solvent and an aromatic hydrocarbon solvent, present in an amount of about 50 to about 95 weight percent of the total weight of the composition.

In another aspect of the present disclosure, an alternate pour point depressant composition for a petroleum fluid is disclosed. The composition comprises: (i) a copolymer of a C20-C24 alpha olefin monomer and a maleic anhydride monomer, wherein the copolymer of the C20-C24 alpha olefin monomer and the maleic anhydride monomer is (i) esterified with an acid catalyst and up to about 2 moles of an alcohol and/or glycol having from between 10 and 40 carbon atoms or (ii) is converted to an imide by reaction with an alkyl amine, wherein the esterified or converted copolymer is present in an amount of about 3 to about 15 or 20 weight percent of the total weight of the composition; (ii) one or more surfactants; and (iii) at least two hydrocarbon solvents. These surfactants comprise (i) a nonionic surfactant comprising a 2-propyl heptanol ethoxylate, wherein the ethoxylate has the formula $C_5H_{11}CH(C_3H_7)CH_2O(A)_nH$, wherein A is an ethyleneoxy group having 2 to 4 carbon atoms and n is 2 to 16, present in an amount of about 1 or 25 to about 30 weight percent of the total weight of the composition; and/or (ii) anionic surfactant comprising an isopropylamine dodecylbenzene sulfonate, present in an amount of about 1 or 10 to about 15 weight percent of the total weight of the composition. The hydrocarbon solvents are an aliphatic hydrocarbon solvent and an aromatic hydrocarbon solvent, present in an amount of about 50 to about 55 or 95 weight percent of the total weight of the composition.

In another aspect of the present disclosure, an alternate pour point depressant composition for a petroleum fluid is disclosed. The composition comprises: (i) a copolymer of a C20-C24 alpha olefin monomer and a maleic anhydride monomer, wherein the copolymer of the C20-C24 alpha olefin monomer and the maleic anhydride monomer is (i) esterified with an acid catalyst and up to about 2 moles of an alcohol and/or glycol having from between 10 and 40 carbon atoms or (ii) is converted to an imide by reaction with an alkyl amine, wherein the converted copolymer is present in an amount of about 3 to about 20 weight percent of the total weight of the composition; (ii) a cationic surfactant comprising an alkoxylated amine comprising the formula:

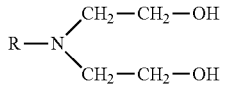

wherein R is coconut oil derived alkyls, present in an amount of about 1 or 5 to about 35 weight percent of the total weight of the composition; and (iii) an aliphatic hydrocarbon solvent and an aromatic hydrocarbon solvent, present in an amount of about 80 to about 90 weight percent of the total weight of the composition.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The present application relates to compositions utilized as pour point depressants for petroleum fluids. As used herein, "petroleum fluids" refers to fluids that contain paraffins, which may precipitate during the oil production process due to their cooling and/or depressurization upon removal from the earthen formation. Paraffin precipitation and deposition is a function of many parameters including but not limited to fluid composition, water cut, fluid velocity, temperature etc. A non-limiting example of petroleum fluids includes oil feedstocks. The pour point depressant compositions exhibit stability and are flowable at temperatures down to as low as −47° C., without the need for further dilution (i.e. "winterized"). As used herein, "winterized" refers to the ability of compositions to remain stable and functional at such low temperatures. For example, petroleum fluids are often stored in above ground tanks and applied as needed. In regions of the world where temperatures may fall below the freezing/gel point of the petroleum fluids, their storage in aboveground tanks may result in the need for a higher dilution in a solvent to avoid their becoming unstable. Improved winterization of the petroleum fluids may improve their stability in colder environments and negate the need for a high dilution of the active ingredient.

The petroleum fluids may be oil feedstocks. Such oil feedstocks may include crude oils, fuel oils, diesel fuel, hydraulic oil, oils of lubricating viscosity, and heating oils. In some embodiments, the oil feedstocks may be crude oil, i.e. oil obtained directly from drilling and before refining. Crude oils vary widely in their physical and chemical properties from one geographical region to another, and from field to field. Crude oils are usually classified into three groups according to the nature of the hydrocarbons they contain: paraffinic, naphthenic, asphaltic, and mixtures thereof. The differences are due to the different proportions of the various molecular types and sizes. Whether paraffinic, naphthenic, or asphaltic, one can contain a large quantity of lighter hydrocarbons and be mobile or contain dissolved gases; another can consist mainly of heavier hydrocarbons and be highly viscous, with little or no dissolved gas. Crude oils can also include heteroatoms containing sulfur, nitrogen, nickel, vanadium and others elements in quantities that impact the refinery processing of the crude oil fractions. For example, light crude oils or condensates can contain sulfur in concentrations as low as 0.01 wt % of sulfur. In contrast, heavy crude oils can contain as much as 5-6 wt % of sulfur. Furthermore, paraffinic crude oils often have a relatively high wax content, e.g. a wax content of 0.1 to 20% by weight percent of oil, typically 3 to 5 wt %, measured at 10° C. below the wax appearance temperature.

The oil feedstocks may be fuel oil, such as a petroleum-based fuel oil, especially a middle distillate fuel oil. Such distillate fuel oils generally boil within the range of from 110° C. to 500° C., e.g. 150° C. to 400° C. The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oil or of both. The above-mentioned low temperature flow problem is most usually encountered with diesel fuels and with heating oils.

Preferably, the compositions are utilized as pour point depressants for petroleum fluids such as crude oil feedstocks. The pour point depressant composition can be added to or mixed with petroleum fluids such as crude oil feedstocks, via a crude oil pipeline by batch or continuous injection, upstream or downstream of the location of any potential cold area likely to result in deposition of wax, gellation, thickening, sludging, etc. The mixing may occur either downhole or above ground, after the crude oil has been produced from a reservoir. In one or more embodiments, the compositions of the present disclosure may be added to a hydrocarbon fluid produced from a well at the well head or at the surface. For example, in some embodiments, the wax inhibitor composition may be added to a hydrocarbon fluid prior to transporting the hydrocarbon fluid in a pipeline or a tank. Also, the composition can be added at the cold area (reservoir, tank, container, etc.) to decrease the pour point of the crude oil. Furthermore, the composition does not require dilution and maintains liquidity and phase stability at low temperatures, thereby allowing the end user to directly dose the products as is.

The winterized pour point depressant compositions comprise a wax and/or paraffin inhibitor copolymer of an alpha olefin and unsaturated dicarboxylic acid anhydride, which is then converted to an ester or imide, and one or more surfactants comprising a nonionic surfactant, and/or an anionic surfactant, and/or a cationic surfactant, and at least two hydrocarbon solvents, as further described below. In an embodiment the pour point depressant composition comprises:

a copolymer of an alpha olefin monomer and an unsaturated dicarboxylic acid anhydride monomer, converted to an ester or an imide and present in an amount of about 1 to about 30 weight percent of the total weight of the composition; and (i) 1. a nonionic surfactant comprising a 2-propyl heptanol alkoxylate, wherein the alkoxylate has the formula $C_5H_{11}CH(C_3H_7)CH_2O(A)_nH$, wherein A is an alkyleneoxy group having 2 to 4 carbon atoms and n is 2 to 16, present in an amount of about 1 to about 40 weight percent of the total weight of the composition and (ii) at least two hydrocarbon solvents, present in an amount of about 45 to about 99 weight percent of the total weight of the composition, 2. a cationic surfactant comprising an alkoxylated amine, present in an amount of about 1 to about 40 weight percent of the total weight of the composition, and 3. at least two hydrocarbon solvents, present in an amount of about 45 to about 99 weight percent of the total weight of the composition, or (ii) 1. an anionic surfactant comprising an amine salt of an alkyl benzene sulfonic acid, present in an amount of about 1 to about 50 weight percent of the total weight of the composition, 2. an ethylene vinyl acetate copolymer, and 3. a hydrocarbon solvent.

In an embodiment the pour point depressant composition comprises:

(a) an esterified copolymer of an alpha olefin monomer and an unsaturated dicarboxylic acid anhydride monomer, present in an amount of about 1 to about 30 weight percent of the total weight of the composition; and one or more surfactants comprising (b) a nonionic surfactant comprising a 2-propyl heptanol alkoxylate, wherein the alkoxylate has the formula $C_5H_{11}CH(C_3H_7)CH_2O(A)_nH$, wherein A is an alkyleneoxy group having 2 to 4 carbon atoms and n is 2 to 16, present in an amount of about 1 to about 40 weight percent of the total weight of the composition; and/or (c) an anionic surfactant comprising an amine salt of an alkyl benzene sulfonic acid, present in an amount of about 5 to about 50 weight percent of the total weight of the composition; and/or (d) a cationic surfactant comprising an alkoxylated amine, present in an amount of about 1 to about 40 weight percent of the total weight of the composition; and (e) at least two hydrocarbon solvents, present in an amount of about 45 to about 99 weight percent of the total weight of the composition.

In an embodiment the pour point depressant composition comprises:

(a) a copolymer of an alpha olefin monomer and an unsaturated dicarboxylic acid anhydride monomer, converted to an ester or an imide and present in an amount of about 1 to about 30 weight percent of the total weight of the composition; and at least one of:

(b) (i) a nonionic surfactant comprising a 2-propyl heptanol alkoxylate, wherein the alkoxylate has the formula $C_5H_{11}CH(C_3H_7)CH_2O(A)_nH$, wherein A is an alkyleneoxy group having 2 to 4 carbon atoms and n is 2 to 16, present in an amount of about 1 to about 40 weight percent of the total weight of the composition and (ii) at least two hydrocarbon solvents, present in an amount of about 45 to about 99 weight percent of the total weight of the composition;

(c) an anionic surfactant comprising an amine salt of an alkyl benzene sulfonic acid, present in an amount of about 1 to about 50 weight percent of the total weight of the composition and an ethylene vinyl acetate copolymer and a hydrocarbon solvent; and (d) (i) a cationic surfactant comprising an alkoxylated amine, present in an amount of about 1 to about 40 weight percent of the total weight of the composition and (ii) at least two hydrocarbon solvents, present in an amount of about 45 to about 99 weight percent of the total weight of the composition.

In an embodiment, the copolymer, surfactants and solvent have the meaning as presented below.

Copolymer of Alpha Olefin and Unsaturated Dicarboxylic Acid Anhydride and Derivatives Therefrom A component in the compositions comprises a wax and/or paraffin precipitation inhibitor, which is a copolymer of an alpha olefin monomer and an esterified unsaturated dicarboxylic acid anhydride monomer. The alpha olefin monomer can comprise between 10 and 40 carbon atoms per molecule, or between 16 and 30 carbon atoms, or between 20 and 24 carbon atoms, individually or in combinations thereof. The alpha-olefin monomers may be mixed alkyl olefins wherein the alkyl groups are about 60-90% (or 80-90% in particular embodiments) in the range of C20 to C24, with the rest of the alkyl components including C10 to C40 alkyl groups, and preferably C16, C18, and C26 to C30 alkyl groups. The alpha olefin monomer may comprise individual olefins or mixtures of various types of olefins, or may be linear or branched. Representative non-limiting examples of such alpha olefins include 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-docosene, 1-tetracosene, 1-hexacosene, 1-octacosene, 1-triacontene, 1-dotriacontene, 1-tetratriacontene, 1-hexatriacontene, 1-octatriacontene, or 1-tetracontene. In some embodiments, the alpha olefin monomer is a mixture of C20 to C24 components.

The alpha olefin monomer and unsaturated dicarboxylic acid anhydride are polymerized by mixing the alpha olefin with at least 0.5 mole, preferably 1 mole of unsaturated dicarboxylic acid anhydride, and heating the mixture to a temperature of from about 50° C. to about 150° C., preferably from 80° C. to 120° C., for approximately 2 to 24 hours, and preferably from 4 to 8 hours. A free radical polymerization promoter such as t-butyl hydroperoxide, azoisobutyl nitrile, benzoyl peroxide, t-butylperoxybenzoate or di-t-butyl peroxide is normally used. As understood by a person skilled in the art, the polymer may be made by conventional methods, including free radical polymerization as mentioned, or by high pressure polymerization, as carried out in an autoclave or tubular reactor.

The resulting addition polymeric product has a number average molecular weight ($M_n$) of about 1,000 to 50,000, or about 1,500 to 30,000 or preferably about 2,000 to 10,000. The unsaturated dicarboxylic acid anhydride is typically itaconic anhydride, citraconic anhydride, aconitic anhydride, acrylic anhydride, maleic anhydride, chloromaleic anhydride, dichloromaleic anhydride, citraconic anhydride, cyclohexyl maleic anhydride, alkyl maleic anhydride, benzyl maleic anhydride, phenyl maleic anhydride, propyl maleic anhydride, and 1,2-diethyl maleic anhydride, individually or in combinations thereof. In some embodiments, the unsaturated dicarboxylic acid anhydride is maleic anhydride.

In such embodiments where maleic anhydride is used as a comonomer, the copolymer has a general formula according to Formula (I) below:

(I)

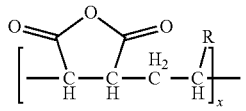

wherein the R group is a C16 to C30 alkyl group, as described above, and X=a value between 3 and 150. This copolymer is known as Armohib® PC-104, available from Akzo Nobel Surface Chemistry LLC. In embodiments where alkyl maleic anhydride is used as a comonomer, at least one of the hydrogens shown on the anhydride moiety of Formula I is instead a C12-C30 alkyl group, while the other hydrogen may remain a hydrogen or may also be a C12-C30 alkyl group.

In some embodiments, the addition product is then esterified with an acid catalyst and up to about 2 moles of an alcohol and/or glycol having from between 10 and 40 carbon atoms per molecule, preferably from between 14 and 28 carbon atoms per molecule. The esterification reaction is conducted at approximately 60° C. to about 170° C. and approximately 1 atm. The alcohol and/or glycol may be linear or branched, saturated or unsaturated, or Guerbet alcohols, either individually or in combinations thereof, but the preferred alcohols are aliphatic, substantially linear, monohydric alcohols. The acid catalyst may include, without limitation, any acidic, non-volatile esterification catalysts, Lewis acids, Bronsted acids (including phosphoric acid), organic acids, substantially non-volatile inorganic acids and their partial esters and heteropolyacids. Particularly suitable esterification catalysts include alkyl, aryl or alkaryl sulfonic acids, such as for example methane sulfonic acid, naphthalene sulfonic acid, p-toluene sulfonic acid, and dodecyl benzene sulfonic acid. Suitable acids may also include aluminum chloride, boron trifluoride, dichloroacetic acid, hydrochloric acid, iodic acid, phosphoric acid, nitric acid, acetic acid, stannic chloride, titanium tetraisopropoxide, dibutyltin oxide, and trichloroacetic acid. When maleic anhydride is the copolymer, upon esterification with the above mentioned acid catalyst and alcohol, a maleic anhydride ester according to Formula (II) may be created:

(II)

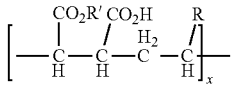

wherein R is as described above and at least about 95% of the R' groups on the created olefin maleic anhydride ester may be C16 to C20 alkyl groups with the remainder being C14 and C22 alkyl groups, and X=a value between 3 and 150. As discussed above, with respect to Formula I, in embodiments where alkyl maleic anhydride is used as a comonomer, at least one of the hydrogens shown on the esterified portion of Formula II is instead a C12-C30 alkyl group, while the other hydrogen may remain a hydrogen or may also be a C12-C30 alkyl group.

The resultant esterified copolymer product contains both alkyl ester and carboxylic acid functionalities. In a particular embodiment, the copolymer is a C20 to C24 alpha olefin and maleic anhydride copolymer known as Armohib® PC-105, available from Akzo Nobel Surface Chemistry LLC.

In some embodiments, the addition product may be further reacted with a suitable amine to form an imide of the copolymer. Suitable amines may be a primary, secondary or tertiary amine, having the general formula of R—$NH_2$, wherein R is an alkylene group having from 2 to 30 carbon atoms per molecule. Such amines may include monoethylamine, isopropylamine, sec-butylamine, t-butylamine, n-pentylamine, tallow amine, hydrogenated tallow amine, cocoamine, soyamine, oleylamine, octadecylamine, hexadecylamine, dodecylamine, 2-ethylhexylamine, dehydrogenated tallowamine, N-coco-1,3-diaminopropane, N-tallow-1,3-diaminopropane, N-oleyl-1,3-diaminopropane, individually or in combinations thereof. In some embodiments, the amine is tallow amine, or hydrogenated tallow amine. When maleic anhydride is the copolymer, upon conversion with the above mentioned amine, an imide according to Formula (III) may be created:

(III)

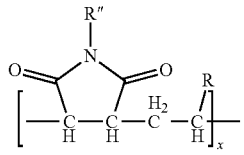

wherein R is as described above and R" is C8-30 or R" is such that at least about 95% of the R" groups on the imide functional group are C16 to C20 alkyl groups with the remainder being C14 and C22 alkyl groups, and X=a value between 3 and 150. As discussed above, with respect to Formula I, in embodiments where alkyl maleic anhydride is used as a comonomer, at least one of the hydrogens shown on the esterified portion of Formula III is instead a C12-C30 alkyl group, while the other hydrogen may remain a hydrogen or may also be a C12-C30 alkyl group.

In one particular embodiment, the imidized copolymer is an imide of a C18 alpha olefin and maleic anhydride copolymer reacted with hydrogenated tallow amine, known as Armohib® PC-301H, available from Akzo Nobel Surface Chemistry LLC. In another particular embodiment, the imidized copolymer is an imide of a C20 or C24 to C24 or C28 alpha olefin and maleic anhydride copolymer reacted with tallow amine, known as Armohib® PC-308, available from Akzo Nobel Surface Chemistry LLC. In another particular embodiment, the copolymer is an imide of a C20 to C24 alpha olefin and maleic anhydride copolymer reacted with tallow amine, known as Armohib® PC-304, available from Akzo Nobel Surface Chemistry LLC.

In some embodiments, the resultant copolymer may be blended with ethylene vinyl acetate copolymer, solvent, and isopropylamine dodecylbenzene sulfonate. Such blend is known as Armohib® PC-150, available from Akzo Nobel Surface Chemistry LLC.

In some embodiments, the copolymer is present in an amount of about 1 to about 30 weight percent of the total weight of the composition, or from about 2 to about 20 or 25 weight percent of the total weight of the composition, and more preferably from about 3 to about 15 or 20 weight percent of the total weight of the composition.

Nonionic Surfactant

The nonionic surfactant component of the present compositions is preferably selected from the group consisting of alkanolamides, alkoxylated alcohols, alkyl phenyl polyethoxylates, alkoxylated phenols, lecithin, hydroxylated lecithin, fatty acid esters, glycerol esters and their ethoxylates, glycol esters and their ethoxylates, esters of propylene glycol, sorbitan, ethoxylated sorbitan, polyglycosides and the like, and mixtures thereof. Alkoxylated alcohols, preferably ethoxylated alcohols, are the preferred nonionic surfactants. The alkoxylated alcohols used herein is preferably an alkoxylated 2-propyl heptanol, which can be illustrated by the Formula (III)

$$C_5H_{11}CH(C_3H_7)CH_2O(A)_nH \quad \text{(III)}$$

wherein A is an alkyleneoxy group having 2-4 carbon atoms and n is 2-16, preferably 3-12. Preferably, 50-100% of all alkyleneoxy groups are ethyleneoxy groups. In those cases where different alkyleneoxy groups are present in the same compound, they may be added randomly or in block. Generally, the alkoxylate is an ethoxylate having 2-7, preferably 3-5 ethyleneoxy groups.

The alkoxylated alcohols described above can be prepared by adding in a conventional manner in the presence of a conventional alkali catalyst, such as potassium hydroxide or sodium hydroxide, the above-mentioned amounts of alkylene oxide to 2-propyl heptanol.

In some aspects, the addition of ethylene oxide is performed using a conventional catalyst which gives a narrower distribution of added ethylene oxide than any alkali catalyst, such as NaOH or KOH. Examples of conventional catalysts giving a narrow distribution of added alkylene oxide are Ca(OH)2, Ba(OH)2, Sr(OH)2 and hydrotalcite. The reaction is preferably conducted in the absence of free water to reduce the amount of by-products and usually at a temperature of about 70° to about 180° C.

In some aspects, the nonionic surfactant is Ethylene 1003, a nonionic surfactant of 2-propyl heptanol ethoxylate, available from Akzo Nobel Surface Chemistry LLC. In some embodiments, the nonionic surfactant is present in an amount of about 1 to about 40 weight percent of the total weight of the composition, and more preferably from about 1 or 2 to about 35 weight percent of the total weight of the composition.

Cationic Surfactants

The cationic surfactant component of the present compositions is an alkoxylated amine. Suitable alkoxylated amines include any ethoxylated amines or ethoxylated diamines capable of forming a water soluble salt with cationic surfactant. Examples include tertiary alkoxylated amines and alkoxylated diamines, ethoxylate ether amines, as well as mixtures thereof. In some aspects, the alkoxylated amine is an ethoxylated amine or ethoxylated diamine that is sold under the Ethomeen® or Ethoduomeen® name, available from Akzo Nobel Surface Chemistry LLC. In some embodiments, the alkoxylated amine, Ethomeen® C/12 has the Formula (IV)

(IV)

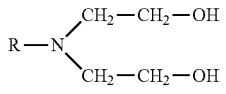

wherein R is coconut oil derived alkyls (e.g., $CH_3(CH_2)_{11}$)

In some embodiments, the cationic surfactant is present in an amount of about 1 to about 40 weight percent of the total weight of the composition, and more preferably from about 1 to about 35 weight percent of the total weight of the composition.

Anionic Surfactant

The anionic surfactant component of the present compositions is an amine salt of an alkyl benzene sulfonic acid. More specifically, the anionic surfactant comprises an amine salt of a straight or branched chain alkylbenzene sulfonate salt in which the alkyl group contains from about 9 to about 18 carbon atoms, including nonyl benzene sulfonate (C9), decyl benzene sulfonate (C10), undecyl benzene sulfonate (C11), dodecylbenzene sulfonate (C12), tridecyl benzene sulfonate (C13), tetradecyl benzene sulfonate (C14), pentadecyl benzene sulfonate (C15), hexadecyl benzene sulfonate (C16), heptadecyl benzene sulfonate (C17) and octadecyl benzene sulfonate (C18). Among these, dodecylbenzene sulfonate and mixtures of salts having carbon number of from 10 to 16 are more preferred.

The amine may be a primary, secondary or tertiary amine, having the general formula of R—$NH_2$, wherein R is an alkylene group having from 2 to 30 carbon atoms per molecule. Such amines may include monoethylamine, dimethylamine, triethylamine, diethyl methylamine, diethylamine, diglycol amine, ethylpropylamine, dipropylamine, isopropylamine, sec-butylamine, t-butylamine, n-pentylamine, tallowamine, hydrogenated tallowamine, cocoamine, soyamine, oleylamine, octadecylamine, hexadecylamine, dodecylamine, 2-ethylhexylamine, dicocoamine, ditallowamine, dehydrogenated tallowamine, didecylamine, dioctadecylamine, N-coco-1,3-diaminopropane, N-tallow-1,3-diaminopropane, N,N,N-trimethyl-N-tallow-1,3-diaminopropane, N-oleyl-1,3-diaminopropane, N,N,N-trimethyl-N-9-octadecenyl-1,3-diaminopropane, 3-tallowalkyl-1,3-hexahydropyrimidine, individually or in combinations thereof. Preferably, the amine salt of alkyl benzene sulfonic acid is isopropylamine dodecylbenzene sulfonate. An example of isopropylamine dodecylbenzene sulfonate is Witconate® 93S, available from Akzo Nobel Surface Chemistry LLC.

In some embodiments, the anionic surfactant is present in an amount of about 1 or 5 to about 50 weight percent of the total weight of the composition, and more preferably from about 1 or 10 to about 45 weight percent of the total weight of the composition.

Solvents

A mixture of two or more solvents is utilized with the composition of the present disclosure. The solvent used in the composition may be chosen from the group including, but not limited, to aliphatic hydrocarbons (e.g., hexane, cyclohexane, pentane, dodecane, decane), organic esters (i.e. ethyl acetate), aromatic hydrocarbons (e.g., benzene, toluene, xylene, light or heavy solvent naphtha, Aromatic 150), ethers (e.g., dioxane, tetrahydrofuran, ethyl ether, tert-butyl methyl ether), halogenated hydrocarbons (e.g., methylene chloride and chloroform), lower alcohols such as methanol, ethanol, 1-propanol, 2-propanol and the like, glycols such as ethylene glycol, propylene glycol, diethylene glycol, dipropylene glycol, polyethylene glycol, polypropylene glycol, polyethylene glycol-polyethylene glycol block copolymers, and the like, and glycol ethers such as 2-methoxyethanol, diethylene glycol monomethylether, 2-butoxyethanol, and the like, and water. The solvents are typically mixed with either any or all of the preceding components (anionic surfactants, nonionic surfactants, cationic surfactants, copolymer of alpha olefin and unsaturated dicarboxylic acid anhydride).

In some embodiments, the solvent is present in an amount of about 45 to about 99 weight percent of the total weight of the composition, and more preferably from about 50 to about 95 weight percent of the total weight of the composition.

The composition may also contain various optional ingredients for improving low temperature flowability and/or other properties, including, without limitation, detergents, storage stabilizers, antioxidants, corrosion inhibitors, cold flow improvers (including, without limitation, comb polymers, polar nitrogen compounds, compounds containing a cyclic ring system, hydrocarbon polymer, polyoxyalkylene compounds, mixtures thereof and the like), demulsifiers, antifoaming agents, cosolvents, package compatibilizers, corrosion inhibitors, scale inhibitors, biocides, and lubricity additives, either used individually or in combinations thereof.

The amount of composition used in treating a petroleum fluid will vary according to various factors such as the base fluid type, the paraffin content in the fluid, the n-paraffin carbon number distribution for the fluid, the type of polymers, the degree of WAT corrections desired, the ambient conditions, etc. The optimum dose rate is normally estimated by means of laboratory measurements such as wax appearance temperature, viscosity, gel strength, wax deposition tendency, etc. Therefore, there are no limitations in this regard. Thus, the copolymers may be added in effective amount, i.e., an amount sufficient to produce some reduction in the wax appearance temperature of a wax-containing fluid. Generally, however, the composition may be added in a concentration of at least 50 ppm in some embodiments, and in a concentration of from 50 and 5000 ppm in other embodiments. In some other embodiments, the concentration varies from 250 to 2000 ppm. Further, one skilled in the art would appreciate that ranges may depend on the types of production fluid being treated, and that the desirable amount is an amount sufficient to achieve the highest variance in WAT at the lowest dosage possible. In one or more embodiments, the amount of composition mixed with the production fluid may be about 1000 ppm.

EXAMPLES

Winterized pour point depressant compositions were prepared by mixing several components, including individual or collective combinations of one or more active wax and/or paraffin inhibitor copolymer components, surfactant components, and solvent components. The active inhibitor and surfactant components are described as follows:

Armohib® PC-105: A copolymer of C20-C24 alpha olefin monomer and maleic anhydride subsequently esterified with C14-C28 alcohol, available from Akzo Nobel Surface Chemistry LLC.

Armohib® PC-150: A C20 to C24 alpha olefin and maleic anhydride copolymer blended with ethylene vinyl acetate copolymer, a solvent, and isopropylamine dodecylbenzene sulfonate, available from Akzo Nobel Surface Chemistry LLC.

Armohib® PC-301H: An imide of a C18 alpha olefin and maleic anhydride copolymer reacted with hydrogenated tallow amine, available from Akzo Nobel Surface Chemistry LLC.

Armohib® PC-304: A copolymer of C20-C24 alpha olefin monomer and maleic anhydride subsequently converted to an imide by reaction with tallow amine, available from Akzo Nobel Surface Chemistry LLC.

Ethylan® 1003: A non-ionic surfactant of 2-propyl heptanol alkoxylate, available from Akzo Nobel Surface Chemistry LLC.

Witconate® 93S: An anionic surfactant of isopropylamine dodecylbenzene sulfonate, available from Akzo Nobel Surface Chemistry LLC.

Ethomeen® C/12: A cationic surfactant of tertiary amine ethoxylate, based on a primary cocoamine, available from Akzo Nobel Surface Chemistry LLC.

The solvents were Aromatic 150, available from ExxonMobil; cyclohexane, available from Fisher Chemical Company; and 2-butoxyethanol, available from Dow Chemical Company (Butyl Cellosolve™).

Each component was added in the following order for each pour point depressant composition tested: Aromatic 150, 2-butoxyethanol and cyclohexane, Ethylan® 1003 and/or Witconate® 93S surfactant and/or Ethomeen® C/12 surfactant, and finally, Armohib® PC-105, Armohib® PC-304 or Armohib® PC-301H active copolymer. As needed, some of the samples were warmed slightly so that the Armohib® PC-105, Armohib® PC-304 or Armohib® PC-301H would go into solution. Each sample was vortexed to ensure proper mixing, and then placed at −15° C. overnight for screening. The samples were made by weight with a total of 10 g per sample. The representative compositions are shown in Table 1 below.

In Table 1 below, the flowability was measured after holding each composition at −15° C. overnight for screening, with a (+) symbol indicating that the composition did flow. The measurement of gelation (gel) using a centrifuge test at 2000 rpm at 2° C. is depicted with a (+) symbol to indicate that the formulation did not gel or copolymer did not precipitate. The pour point measurement of the pour point depressant compositions is shown as PPT, and was measured in accordance with ASTM D97—Standard Test Method for Pour Point of Petroleum Products.

TABLE 1

| Sample | Ethomeen C/12 (wt %) | Armohib PC-105 (wt %) | Witconate 93S (wt %) | Ethylan 1003 (wt %) | Cyclo-hexane (wt %) | Aromatic 150 (wt %) | Flowability at −15° C. | Stability (2° C.) | PPT (° C.) |
|---|---|---|---|---|---|---|---|---|---|
| 1 | 0 | 7.5 | 30 | 0 | 22.5 | 40 | + | + | −16 |
| 2 | 0 | 9 | 40 | 0 | 34.5 | 16.5 | + | + | −17 |
| 3 | 0 | 8.5 | 40.2 | 0 | 32.2 | 19.1 | + | + | −17 |
| 4 | 0 | 6 | 12.3 | 27.3 | 27.2 | 27.3 | + | + | −47 |
| 5 | 0 | 7 | 0 | 8 | 26 | 59 | + | + | −14 |
| 6 | 0 | 7 | 0 | 12 | 26 | 55 | + | + | −14 |
| 7 | 0 | 5 | 0 | 9.3 | 25.4 | 60.3 | + | + | −17 |
| 8 | 0 | 5 | 0 | 33.3 | 40.8 | 20.9 | + | + | −17 |
| 9 | 0 | 10 | 30 | 0 | 10 | 50 | + | + | −22 |
| 10 | 0 | 10 | 30 | 0 | 40 | 20 | + | + | −23 |
| 11 | 0 | 10 | 20 | 0 | 28 | 42 | + | + | −27 |
| 12 | 0 | 10 | 20 | 3.5 | 36.8 | 29.8 | + | + | −26 |
| 13 | 0 | 11.3 | 0 | 7.5 | 25.6 | 55.6 | + | + | −16 |
| 14 | 12 | 7 | 0 | 0 | 26 | 55 | + | + | −19 |
| 15 | 9.3 | 5 | 0 | 0 | 25.4 | 60.3 | + | + | −23 |
| 16 | 0 | 12.5 | 11.3* | 0 | 21.9 | 54.3 | − | NA | NA |

*An anionic surfactant different from Witconate 93S (a phosphate ester) was used in Sample 16.

Comparative Example

Various formulations were made with: (i) Armohib® PC-105, no surfactant, and two solvents; and (ii) Armohib® PC-105, no surfactant and only one solvent, and are shown in Table 2 below. For this example, the solvents were hexylene glycol, cyclohexane, and Aromatic 150. Such formulations depicted negative results in terms of flowability and gellation. The flowability was measured after holding each composition at −15° C. overnight for screening, with a (−) symbol indicating that the composition did not flow. The measurement of gelation (gel) using a centrifuge test at 2000 mm at 2° C. is depicted with a (−) symbol to indicate that the formulation did gel.

TABLE 2

| Sample | Armohib PC-105 (wt %) | Hexylene glycol (wt %) | Cyclo-hexane (wt %) | Aromatic 150 (wt %) | Flowability at −15° C. | Gel |
|---|---|---|---|---|---|---|
| A | 5 | 0 | 95 | 0 | − | − |
| B | 10 | 0 | 0 | 90 | − | − |
| C | 12.5 | 87.5 | 0 | 0 | − | − |
| D | 7 | 0 | 28.45 | 64.55 | − | − |
| E | 7 | 0 | 29.85 | 63.15 | − | − |

In Tables 3 through 5 below, formulations were prepared using Armohib® PC-304 or Armohib® PC-150 copolymer, 2-butoxyethanol and Aromatic 150 and, optionally, nonionic or cationic surfactants. Flowability was measured after holding each composition at −15° C. overnight for screening; with a (+) symbol indicating that the composition did flow. Stability was assessed using a centrifuge test at 2000 rpm for 2 hours at decreasing temperature. A (+) result indicates that the formulation did not gel and the copolymer did not precipitate; a (−) symbol indicates that the formulation did gel. For all samples except 17 and 18, static stability was assessed over a period of two weeks at −15° C.; all samples below were stable.

TABLE 3

| | Compostition (wt %) | | | | Stability | | | |
|---|---|---|---|---|---|---|---|---|
| Sample | Armohib PC-150 | 2-butoxy-ethanol | Aro-matic 150 | Over-night −15° C. | 0° C. | −5° C. | −10° C. | −15° C. |
| 17 | 5 | 35 | 60 | Clear | Pass | Pass | Pass | Pass |

TABLE 4

| Sample | Composition (wt %) Armohib PC-304 | Ethylan 1003 | 2-butoxy-ethanol | Aromatic 150 | Overnight −15° C. | Stability 0° C. | −5° C. | −10° C. | −15° C. |
|---|---|---|---|---|---|---|---|---|---|
| 18 | 10 | — | 30 | 60 | + | + | + | + | − |
| 19 | 10 | 5 | 10 | 75 | + | + | + | + | + |
| 20 | 10 | 10.8 | 15.9 | 63.3 | + | + | + | + | + |
| 21 | 15 | 5 | 10 | 70 | + | + | + | + | + |
| 22 | 18 | 4.0 | 9.0 | 69.0 | + | + | + | + | + |
| 23 | 20 | 3.34 | 8.34 | 68.32 | + | + | + | + | + |

TABLE 5

| Sample | Composition (wt %) Armohib PC-304 | Ethomeen C/12 | 2-butoxy-ethanol | Aromatic 150 | Overnight −15° C. | Stability 0° C. | −5° C. | −10° C. | −15° C. |
|---|---|---|---|---|---|---|---|---|---|
| 18 | 10 | — | 30 | 60 | + | + | + | + | − |
| 24 | 10 | 5 | 10 | 75 | + | + | + | + | + |
| 25 | 10 | 10.8 | 15.8 | 63.4 | + | + | + | + | + |
| 26 | 15 | 5 | 10 | 70 | + | + | + | + | + |
| 27 | 15 | 9 | 16 | 60 | + | + | + | + | + |
| 28 | 15 | 6.6 | 11.6 | 66.8 | + | + | + | + | + |
| 29 | 15 | 6.6 | 14.6 | 63.8 | + | + | + | + | + |
| 30 | 16 | 4.67 | 9.67 | 69.66 | + | + | + | + | + |
| 31 | 18 | 4.0 | 9.0 | 69.0 | + | + | + | + | + |

In Table 6 below, samples were prepared using Armohib® PC-301H. Both Ethylene 1003 and Ethomeen® C/12 were used as the surfactant with the same results. −15° C. results were not available for Samples 33-36.

TABLE 6

| Sample | Composition (wt %) Armohib PC-301H | Surfactant | 2-butoxy-ethanol | Aromatic 150 | Overnight −15° C. | Stability 0° C. | −5° C. | −10° C. | −15° C. |
|---|---|---|---|---|---|---|---|---|---|
| 32 | 10 | 5 | 10 | 75 | Clear | Pass | Pass | Pass | Pass |
| 33 | 15 | 5 | 7 | 73 | Clear | Pass | Pass | Pass | NA |
| 34 | 15 | 5 | 13 | 67 | Clear | Pass | Pass | Pass | NA |
| 35 | 12.5 | 5 | 10 | 72.5 | Clear | Pass | Pass | Pass | NA |
| 36 | 13.75 | 5 | 8.5 | 72.75 | Clear | Pass | Pass | Pass | NA |

The preceding detailed description and examples have been provided by way of explanation and illustration, and are not intended to limit the scope of the disclosure. Many variations in the present embodiments illustrated herein will be apparent to one of ordinary skill in the art, and remain within the scope of the disclosure and their equivalents. The skilled person in the art will recognize many variations that are within the spirit of the disclosure and scope of any current or future claims.

What is claimed is:

1. A pour point depressant composition comprising:

a copolymer of an alpha olefin monomer and an unsaturated dicarboxylic acid anhydride monomer, converted to an ester or an imide and present in an amount of from about 1 to about 30 weight percent of the total weight of the composition; and (i) 1. a nonionic surfactant comprising a 2-propyl heptanol alkoxylate, wherein the alkoxylate has the formula $C_5H_{11}CH(C_3H_7)CH_2O(A)_nH$, wherein A is an alkyleneoxy group having 2 to 4 carbon atoms and n is 2 to 16, present in an amount of from about 1 to about 40 weight percent of the total weight of the composition, 2. a cationic surfactant comprising an alkoxylated amine, present in an amount of from about 1 to about 40 weight percent of the total weight of the composition, and 3. at least two hydrocarbon solvents, present in an amount of from about 45 to about 99 weight percent of the total weight of the composition, or (ii) 1. an anionic surfactant comprising an amine salt of an alkyl benzene sulfonic acid, present in an amount of from about 1 to about 50 weight percent of the total weight of the composition, 2. an ethylene vinyl acetate copolymer, and 3. a hydrocarbon solvent.

2. The pour point depressant composition of claim 1, wherein the alpha olefin monomer comprises a C10-C40 alpha olefin monomer.

3. The pour point depressant composition of claim 2, wherein the alpha olefin monomer comprises a C20-C28 alpha olefin monomer.

4. The pour point depressant composition of claim 1, wherein the copolymer of an alpha olefin monomer and an unsaturated dicarboxylic acid anhydride monomer is esterified with an acid catalyst and up to 2 moles of an alcohol and/or glycol having from 10 and 40 carbon atoms.

5. The pour point depressant composition of claim 1 wherein the alkyleneoxy group is an ethyleneoxy group.

6. The pour point depressant composition of claim 1, wherein the unsaturated dicarboxylic acid anhydride monomer is selected from the group consisting of itaconic anhydride, citraconic anhydride, aconitic anhydride, maleic anhydride, alkyl maleic anhydride, chloromaleic anhydride, dichloromaleic anhydride, citraconic anhydride, cyclohexyl maleic anhydride, benzyl maleic anhydride, phenyl maleic anhydride, propyl maleic anhydride, and 1,2-diethyl maleic anhydride, individually or in combinations thereof.

7. The pour point depressant composition of claim 6, wherein the unsaturated dicarboxylic acid anhydride monomer comprises a maleic anhydride monomer.

8. The pour point depressant composition of claim 1, wherein the amine salt has an amine of 2 to 30 carbon atoms, and the alkyl benzene sulfonic acid comprises a straight or branched chain alkylbenzene sulfonate salt in which the alkyl group contains from 9 to 18 carbon atoms.

9. The pour point depressant composition of claim 8, wherein the amine salt of the alkyl benzene sulfonic acid is an isopropylamine dodecylbenzene sulfonate.

10. The pour point depressant composition of claim 1, wherein the alkoxylated amine has the formula:

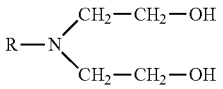

wherein R is coconut oil derived alkyls.

11. The pour point depressant composition of claim 1, further comprising a solvent chosen from organic esters, ethers, methanol, ethanol, 1-propanol, 2-propanol, ethylene glycol, propylene glycol, diethylene glycol, dipropylene glycol, polyethylene glycol, polypropylene glycol, polyethylene glycol-polyethylene glycol block copolymers, 2-methoxyethanol, diethylene glycol monomethylether, 2-butoxyethanol, water, either individually or in combinations thereof.

12. The pour point depressant composition of claim 1, wherein the at least two hydrocarbon solvents comprise aromatic hydrocarbons and aliphatic hydrocarbons.

13. A pour point depressant composition comprising:

(a) a copolymer of a C20-C28 alpha olefin monomer and maleic anhydride monomer, wherein the copolymer of the C20-C28 alpha olefin monomer and the maleic anhydride monomer is (i) esterified with an acid catalyst and up to 2 moles of an alcohol and/or glycol having from 10 and 40 carbon atoms or (ii) is converted to an imide by reaction with an alkyl amine, wherein the copolymer is present in an amount of from about 1 to about 20 weight percent of the total weight of the composition; and at least one of:

(b) (i) a nonionic surfactant comprising a 2-propyl heptanol ethoxylate, wherein the ethoxylate has the formula $C_5H_{11}CH(C_3H_7)CH_2O(A)_nH$, wherein A is an ethyleneoxy group having 2 to 4 carbon atoms and n is 2 to 16, present in an amount of from about 2 to about 35 weight percent of the total weight of the composition and (ii) an aliphatic hydrocarbon solvent and an aromatic hydrocarbon solvent, the solvents together present in an amount of from about 50 to about 95 weight percent of the total weight of the composition;

(c) an anionic surfactant comprising an isopropylamine dodecylbenzene sulfonate, present in an amount of from about 1 to about 45 weight percent of the total weight of the composition and an ethylene vinyl acetate copolymer and a hydrocarbon solvent; and (d) (i) a cationic surfactant comprising an alkoxylated amine having the formula:

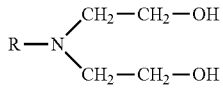

wherein R is coconut oil derived alkyls, present in an amount of from about 1 to about 35 weight percent of the total weight of the composition and (ii) an aliphatic hydrocarbon solvent and an aromatic hydrocarbon solvent, the solvents together present in an amount of from about 50 to about 95 weight percent of the total weight of the composition.

14. A pour point depressant composition comprising:

(i)(a) a copolymer of a C20-C28 alpha olefin monomer and maleic anhydride monomer, wherein the copolymer of the C20-C28 alpha olefin monomer and the maleic anhydride monomer is (i) esterified with an acid catalyst and up to 2 moles of an alcohol and/or glycol having from 10 and 40 carbon atoms or (ii) is converted to an imide by reaction with an alkyl amine, wherein the copolymer is present in an amount of from about 1 to about 20 weight percent of the total weight of the composition; and at least one of:

(i)(b) a nonionic surfactant comprising a 2-propyl heptanol ethoxylate, wherein the ethoxylate has the formula $C_5H_{11}CH(C_3H_7)CH_2O(A)_nH$, wherein A is an ethyleneoxy group having 2 to 4 carbon atoms and n is 2 to 16, present in an amount of from about 1 to about 30 weight percent of the total weight of the composition and an aliphatic hydrocarbon solvent and an aromatic hydrocarbon solvent, the solvents together present in an amount of from about 50 to about 95 weight percent of the total weight of the composition; and (i)(c) an anionic surfactant comprising an isopropylamine dodecylbenzene sulfonate, present in an amount of from about 1 to about 15 weight percent of the total weight of the composition and an ethylene vinyl acetate copolymer and a hydrocarbon solvent, or (ii)(a) a copolymer of a C20-C28 alpha olefin monomer and maleic anhydride monomer, wherein the esterified copolymer of the C20-C28 alpha olefin monomer and the maleic anhydride monomer is (i) esterified with an acid catalyst and up to 2 moles of an alcohol and/or glycol having from 10 and 40 carbon atoms or (ii) is converted to an imide by reaction with an alkyl amine, wherein the copolymer is present in an amount of from about 3 to about 20 weight percent of the total weight of the composition; and (ii)(b) a cationic surfactant comprising the formula

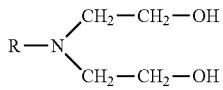

wherein R is coconut oil derived alkyls, present in an amount of from 1 to 35 weight percent of the total weight of the composition; and (ii)(c) an aliphatic hydrocarbon solvent and an aromatic hydrocarbon solvent, together in an amount of from about 50 to about 95 weight percent of the total weight of the composition.

15. The pour point depressant composition of claim 1, wherein the copolymer of an alpha olefin monomer and an unsaturated dicarboxylic acid anhydride monomer is converted to an amide by reaction with up to 2 moles of an alkyl amine having from 8 and 30 carbon atoms.

* * * * *